US007564187B2

(12) United States Patent
Kang et al.

(10) Patent No.: US 7,564,187 B2
(45) Date of Patent: Jul. 21, 2009

(54) PLASMA DISPLAY PANEL (PDP)

(75) Inventors: Kyoung-Doo Kang, Suwon-si (KR); Won-Ju Yi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 532 days.

(21) Appl. No.: 11/501,765

(22) Filed: Aug. 10, 2006

(65) Prior Publication Data

US 2007/0046202 A1 Mar. 1, 2007

(30) Foreign Application Priority Data

Aug. 29, 2005 (KR) ..... 10-2005-0079224

(51) Int. Cl.
*H01J 17/49* (2006.01)

(52) U.S. Cl. ..... 313/585; 313/586; 313/587

(58) Field of Classification Search ..... None
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 5,982,095 | A * | 11/1999 | Jin et al. | 313/582 |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 7,154,224 | B2 * | 12/2006 | Woo et al. | 313/582 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Ashok Patel
(74) *Attorney, Agent, or Firm*—Robert E. Bushnell, Esq.

(57) ABSTRACT

A Plasma Display Panel (PDP) includes: a first substrate; a second substrate arranged parallel to the first substrate; first barrier ribs arranged between the first and second substrates and defining discharge cells with the first and second substrates; second barrier ribs arranged between the first and second substrates, defining the discharge cells with the first substrate, the second substrate, and the first barrier ribs and being wider than the first barrier ribs; first discharge electrodes arranged inside the first barrier ribs to surround the discharge cells; second discharge electrodes arranged inside the second barrier ribs to surround the discharge cells and separated from the first discharge electrodes; phosphor layers arranged closer to the first barrier ribs and arranged inside the discharge cells; and a discharge gas contained within the discharge cells.

24 Claims, 9 Drawing Sheets

U.S. PATENT DOCUMENTS

| | | | | |
|---|---|---|---|---|
| 7,315,123 | B2 * | 1/2008 | Hur et al. | 313/586 |
| 7,323,819 | B2 * | 1/2008 | Hong et al. | 313/584 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL (PDP)

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on the 29 Aug. 2005 and there duly assigned Serial No. 10-2005-0079224.

BACKGROUND OF THE INVENTION

1. Field of the Invention

The present invention relates to a Plasma Display Panel (PDP), and more particularly, to a PDP having an enlarged surface in which a discharge occurs.

2. Description of the Related Art

Plasma Display Panels (PDPs) have recently replaced conventional Cathode Ray Tube (CRT) displays. In a PDP, a discharge gas is sealed between two substrates on which a plurality of discharge electrodes are formed, a discharge voltage is supplied, and phosphors formed in a predetermined pattern are excited by ultraviolet rays generated by the discharge voltage, whereby a desired image is obtained.

In an AC three-electrode surface discharge Plasma Display Panel (PDP), due to a structure in which a scanning electrode, a common electrode, a bus electrode, a dielectric layer covering these electrodes and a protective layer are sequentially formed on a lower surface of a first substrate, a substantial portion (approximately 40%) of visible light rays emitted by a phosphor layer is absorbed, which lowers luminous efficiency.

Moreover, when the AC three-electrode surface discharge PDP displays the same image for a long time, the phosphor layer is ion sputtered by charged particles from the discharge gas, which causes permanent residual image.

SUMMARY OF THE INVENTION

The present invention provides a Plasma Display Panel (PDP) in which a discharge surface is enlarged, a voltage of a sustain discharge is reduced and an aperture ratio and a transmission ratio are remarkably increased and a discharge efficiency is remarkably improved.

According to one aspect of the present invention, a Plasma Display Panel (PDP) is provided including: a first substrate; a second substrate arranged parallel to the first substrate; first barrier ribs arranged between the first and second substrates and defining discharge cells with the first and second substrates; second barrier ribs arranged between the first and second substrates and defining the discharge cells with the first substrate, the second substrate, and the first barrier ribs, the second barrier ribs being wider than the first barrier ribs; first discharge electrodes arranged inside the first barrier ribs to surround the discharge cells; second discharge electrodes arranged inside the second barrier ribs to surround the discharge cells, the second discharge electrodes being separated from the first discharge electrodes; phosphor layers arranged inside the discharge cells, the phosphor layers being closer to the first barrier ribs than to the second barrier ribs; and a discharge gas contained within the discharge cells.

The first discharge electrodes preferably extend in one direction and the second discharge electrodes extend to cross the first discharge electrodes.

The PDP preferably further includes address electrodes crossing the first and second discharge electrodes and the first and second discharge electrodes extend in one direction.

One of the first and second substrates is preferably devoid of phosphor layers, and the address electrodes are preferably arranged on the one of the first and second substrates devoid of phosphor layers, and a dielectric layer is preferably arranged on the address electrodes. One of the first and second substrates is preferably closer to the first barrier ribs and has grooves and the phosphor layers are arranged in the grooves.

A pair of first discharge electrodes is preferably arranged inside the first barrier ribs and a pair of second discharge electrodes is preferably arranged inside the second barrier ribs, and a distance between the pair of second discharge electrodes is preferably greater than a distance between the pair of first discharge electrodes.

According to another aspect of the present invention, a Plasma Display Panel (PDP) is provided including: a first substrate; a second substrate arranged parallel to the first substrate; barrier ribs arranged between the first and second substrates and defining discharge cells with the first and second substrates and having cross-sections having a trapezoid shape; first discharge electrodes arranged inside the barrier ribs to surround the discharge cells; second discharge electrodes arranged inside the barrier ribs to surround the discharge cells, the second discharge electrodes being separated from the first discharge electrodes; phosphor layers arranged closer to a portion of the barrier ribs having a minimum cross-sectional width than to a portion of the barrier ribs having a maximum cross-sectional width, the phosphor layers being arranged inside the discharge cells; and a discharge gas contained within the discharge cells.

The first discharge electrodes preferably extend in one direction and the second discharge electrodes extend to cross the first discharge electrodes The PDP preferably further includes address electrodes crossing the first and second discharge electrodes and the first and second discharge electrodes extend in one direction.

One of the first and second substrates is preferably devoid of phosphor layers, and the address electrodes are preferably arranged on the one of the first and second substrates devoid of phosphor layers, and a dielectric layer is preferably arranged on the address electrodes. One of the first and second substrates is preferably closer to the cross-sectional portion of the barrier ribs having a minimum width, and the one of the first and second substrates closer to the cross-sectional portion of the barrier ribs preferably has grooves and the phosphor layers are preferably arranged in the grooves.

A pair of first discharge electrodes and a pair of second discharge electrodes are preferably arranged inside the barrier ribs, and a distance between the pair of second discharge electrodes is preferably greater than a distance between the pair of first discharge electrodes.

According to still another aspect of the present invention, a Plasma Display Panel (PDP) is provided including: a first substrate; a second substrate arranged parallel to the first substrate; first barrier ribs arranged between the first and second substrates and defining discharge cells with the first and second substrates; second barrier ribs arranged between the first and second substrates, defining the discharge cells with the first substrate, the second substrate, and the first barrier ribs, the second barrier ribs being wider than the first barrier ribs; third barrier ribs arranged between the first and second substrates, defining the discharge cells with the first substrate, the second substrate, the first barrier ribs, and the second barrier ribs, the third barrier ribs being wider than the second barrier ribs; first discharge electrodes arranged inside the first barrier ribs to surround the discharge cells; second discharge electrodes arranged inside the second barrier ribs to surround the discharge cells, the second discharge electrodes being separated from the first discharge electrodes; third discharge electrodes arranged inside the third barrier ribs to surround the discharge cells, the third discharge electrodes being separated from the second discharge electrodes; phosphor layers arranged closer to the first barrier ribs than to the second and third barrier ribs, the phosphor layers being arranged inside the discharge cells; and a discharge gas contained within the discharge cells.

One of the first through third discharge electrodes preferably extends to cross directions of the other of the first through third discharge electrodes.

One of the first and second substrates is preferably closer to the first barrier ribs, and the one of the first and second substrates closer to the first barrier ribs preferably has grooves and the phosphor layers are preferably arranged in the grooves.

A pair of first discharge electrodes is preferably arranged inside the first barrier ribs and a pair of second discharge electrodes is preferably arranged inside the second barrier ribs, and a distance between the pair of second discharge electrodes is preferably greater than a distance between the pair of first discharge electrodes. A pair of first discharge electrodes is preferably arranged inside the first barrier ribs, a pair of second discharge electrodes is preferably arranged inside the second barrier ribs and a pair of third discharge electrodes is preferably arranged inside the third barrier ribs, and a distance between the pair of third discharge electrodes is preferably greater than a distance between the pair of second discharge electrodes.

According to yet another aspect of the present invention, a Plasma Display Panel (PDP) is provided including: a first substrate; a second substrate arranged parallel to the first substrate; barrier ribs arranged between the first and second substrates, defining discharge cells with the first and second substrates and having cross-sections having a trapezoid shape; first discharge electrodes arranged inside the barrier ribs to surround the discharge cells; second discharge electrodes arranged inside the barrier ribs to surround the discharge cells, the second discharge electrodes being separated from the first discharge electrodes; third discharge electrodes arranged inside the barrier ribs to surround the discharge cells, the third discharge electrodes being separated from the second discharge electrodes; phosphor layers arranged closer to a portion of the barrier ribs having a minimum width cross-section than to a portion of the barrier ribs having a maximum width cross-section, the phosphor layers being arranged inside the discharge cells; and a discharge gas contained within the discharge cells.

One of the first through third discharge electrodes preferably extends to cross directions of the other of the first through third discharge electrodes.

One of the first and second substrates is preferably closer to the portion of the barrier ribs having the minimum width cross-section, and the one of the first and second substrates closer to the portion of the barrier ribs having the minimum width cross-section preferably has grooves and the phosphor layers are preferably arranged in the grooves.

A pair of first discharge electrodes and a pair of second discharge electrodes are preferably arranged inside the barrier ribs, and a distance between the pair of second discharge electrodes is preferably greater than a distance between the pair of first discharge electrodes.

A pair of first discharge electrodes, a pair of second discharge electrodes, and a pair of third discharge electrodes are preferably arranged inside the barrier ribs, and a distance between the pair of third discharge electrodes is preferably greater than a distance between the pair of second discharge electrodes.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
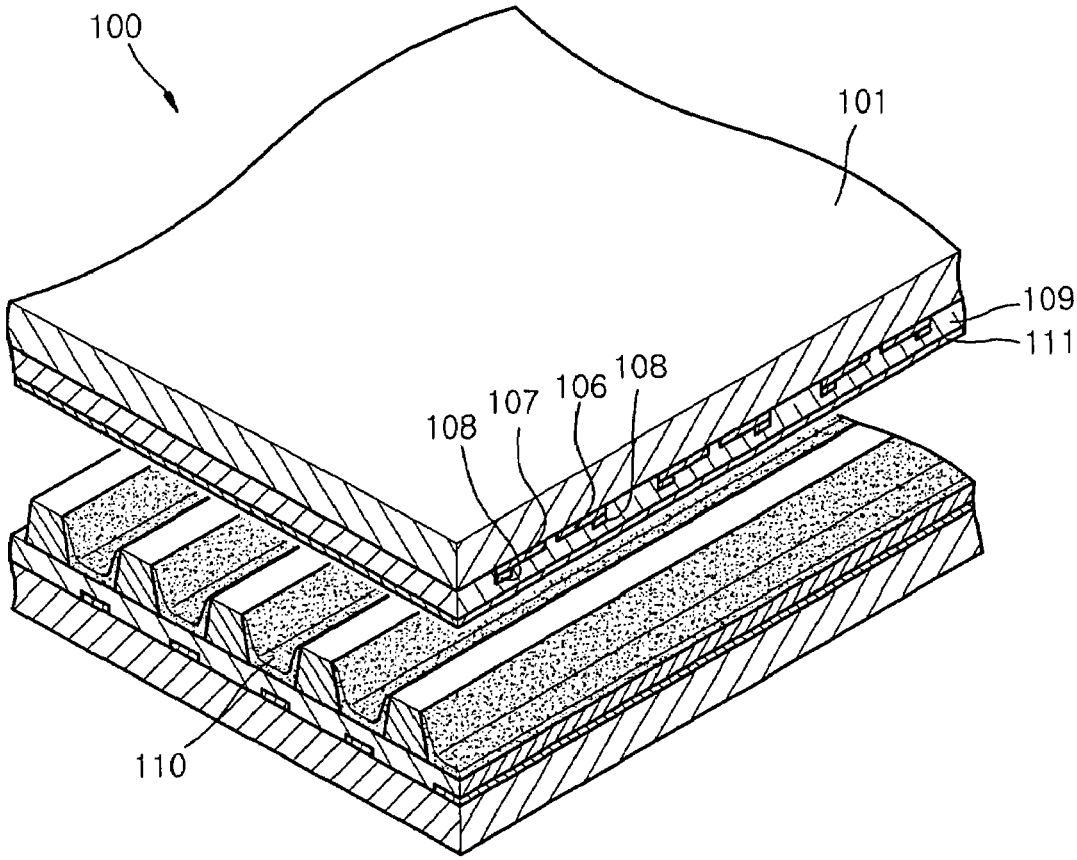
FIG. 1 is a partially cutaway perspective view of a Plasma Display Panel (PDP)

FIG. 1 is a partially cutaway and an exploded perspective view of an AC three-electrode surface discharge Plasma Display Panel (PDP) 100. Referring to FIG. 1, due to a structure in which a scanning electrode 106, a common electrode 107, a bus electrodes 108, a dielectric layer 109 covering the electrodes 106, 107, and 108 and a protective layer 111 are sequentially formed on a lower surface of a first substrate 101, a substantial portion (approximately 40%) of visible light rays emitted by a phosphor layer 110 is absorbed, which lowers luminous efficiency.

Moreover, when the AC three-electrode surface discharge PDP 100 displays the same image for a long time, the phosphor layer 110 is ion sputtered by charged particles from the discharge gas, which causes permanent residual image.

Figure 2:
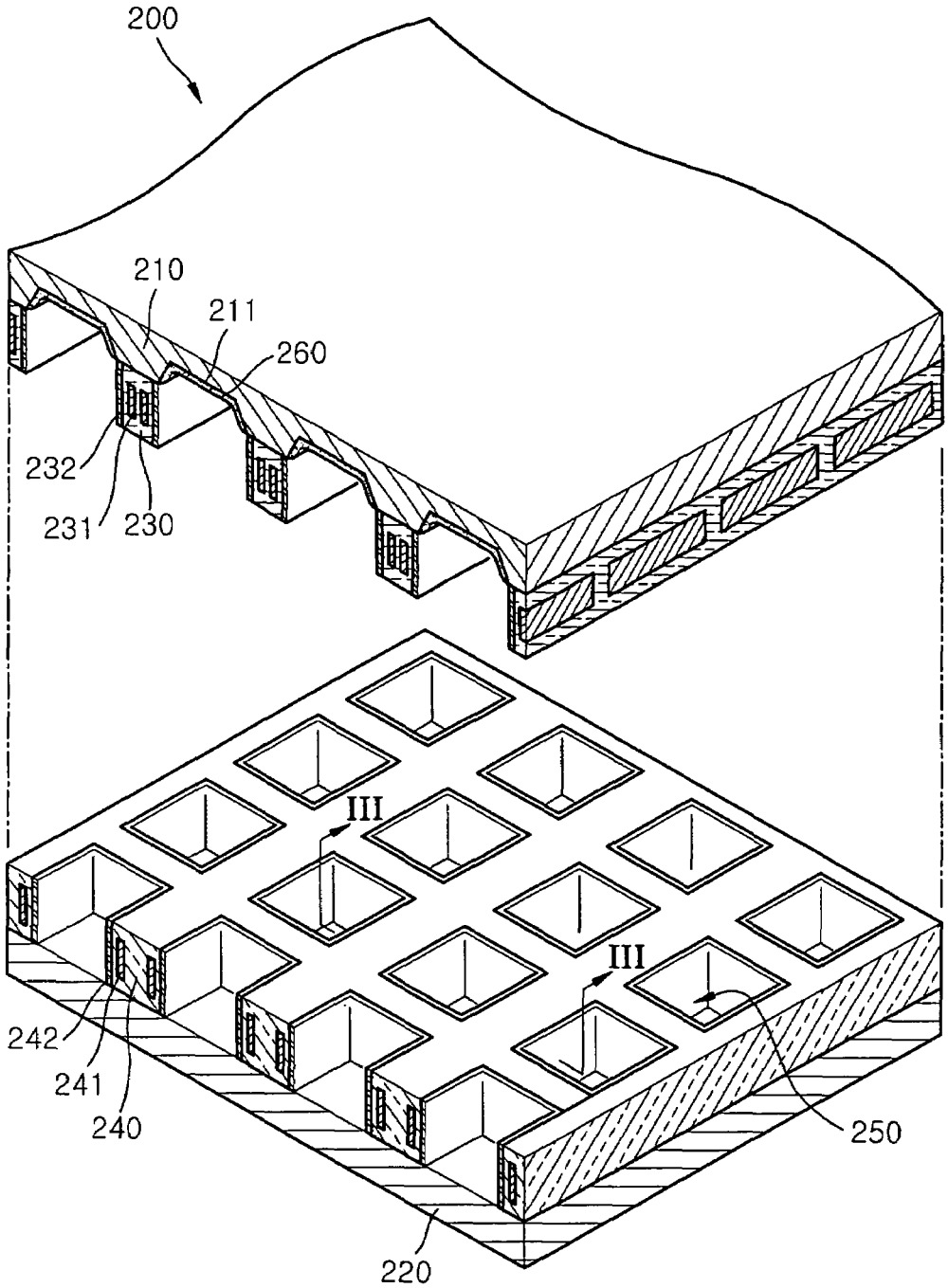
FIG. 2 is a partially cutaway perspective view of a PDP according to an embodiment of the present invention.
Figure 3:
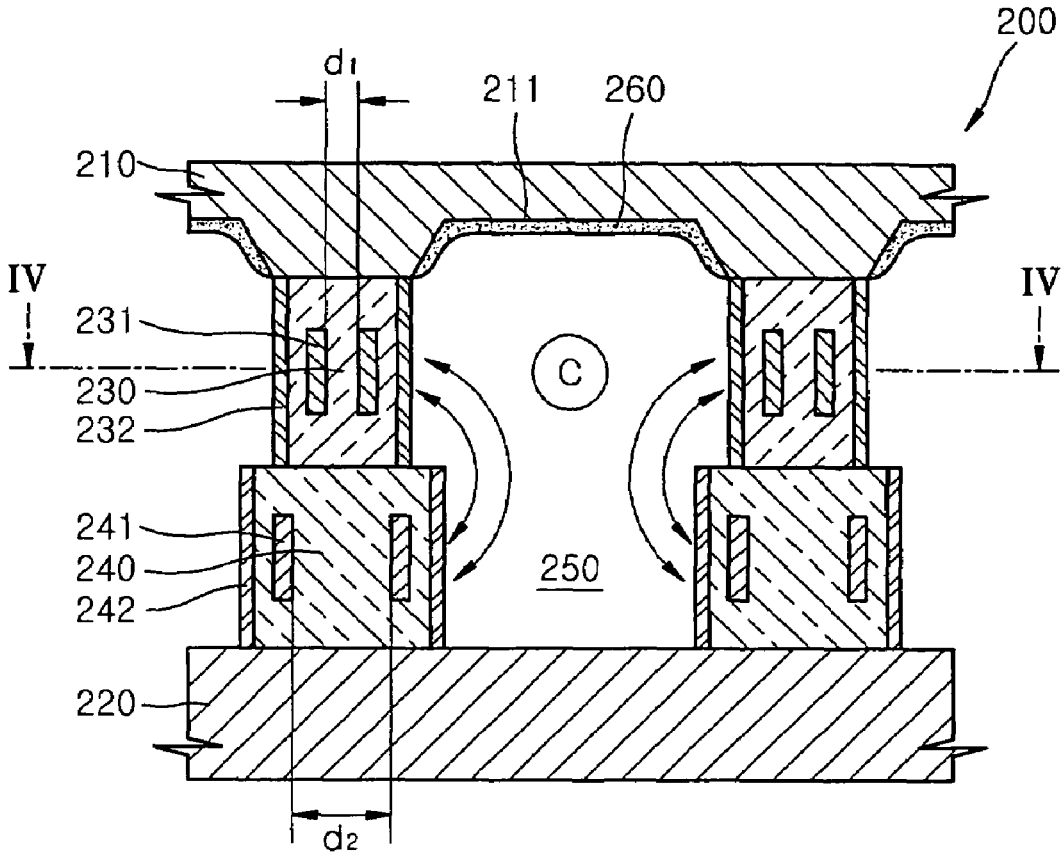
FIG. 3 is a cross-sectional view of the PDP taken along line III-III of FIG. 2.
Figure 4:
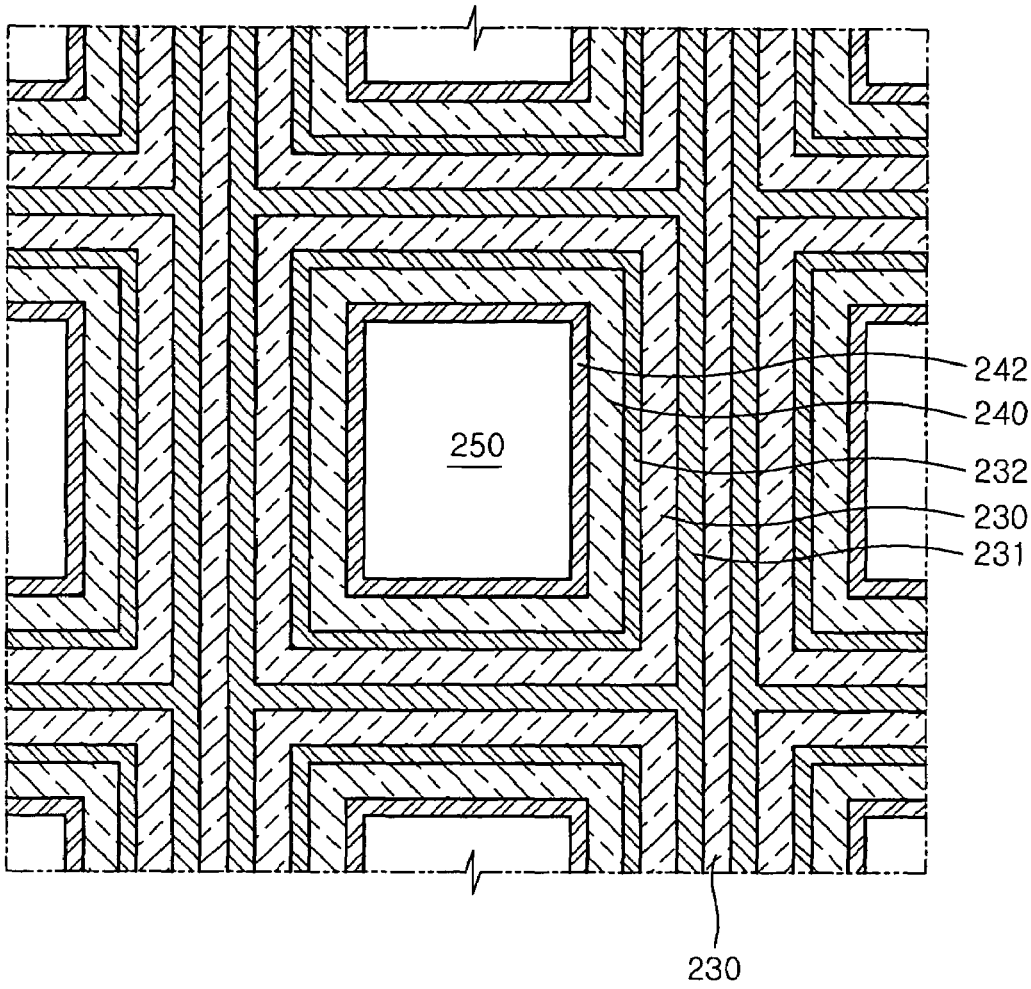
FIG. 4 is a cross-sectional view of the PDP taken along line IV-IV of FIG. 3.

FIG. 2 is a partially cutaway perspective view of a Plasma Display Panel (PDP) according to an embodiment of the present invention, FIG. 3 is a cross-sectional view of the PDP taken along line III-III of FIG. 2, and FIG. 4 is a cross-sectional view of the PDP taken along line IV-IV of FIG. 3.

Referring to FIGS. 2, 3, and 4, a PDP 200 includes a first substrate 210 which is transparent, and a second substrate 220 separated from the first substrate 210 by a predetermined gap so as to be parallel thereto.

The first substrate 210 and the second substrate 220 define a plurality of discharge cells 250 partitioned by first barrier ribs 230 and second barrier ribs 240.

According to the current embodiment of the present invention, since the first substrate 210 is transparent, visible light rays generated by a discharge pass through the first substrate 210. However, the present invention is not limited thereto. That is, the second substrate 220 can be transparent or both the first and second substrates 210 and 220 can be transparent.

The first barrier ribs 230 are arranged between the first substrate 210 and the second substrate 220. The first barrier ribs 230 can extend from the second barrier ribs 240. However, the first barrier ribs 230 can extend from the first substrate 210.

The first barrier ribs 230 are formed of a dielectric substance, and a plurality of first discharge electrodes 231 is arranged inside the dielectric substance. A first protective layer 232 is formed on side surfaces of the first barrier ribs 230.

The second barrier ribs 240 are also formed of a dielectric substance, and a plurality of second discharge electrodes 241 is arranged inside the dielectric substance.

Widths of the second barrier ribs 240 are larger than those of the first barrier ribs 230. A second protective layer 242 is formed on side surfaces of the second barrier ribs 240.

The first discharge electrodes 231 and the second discharge electrodes 241 surround the discharge cells 250. The first discharge electrodes 231 and the discharge electrodes 241 to need not be transparent and thus can be formed of a conductive metallic material. In this way, the first discharge electrodes 231 and the second discharge electrodes 241 can be formed of a metallic material having good conductivity and low resistance, such as Ag, Al or Cu. Thus, there are many advantages in that a response speed caused by a discharge is increased, signals are not distorted and power consumption required for a sustain discharge is reduced.

In addition, the first discharge electrodes 231 and the second discharge electrodes 241 are formed in a ladder shape but can be formed in various shapes, such as ring shapes or rectangular loop shapes.

According to the current embodiment of the present invention, the first discharge electrodes 231 serve as scan electrodes and the second discharge electrodes 241 serve as address electrodes. However, the present invention is not limited thereto.

According to the current embodiment of the present invention, a non-discharge space between the adjacent discharge cells 250 does not exist. However, the present invention is not limited thereto. That is, in the PDP according to the present invention, a non-discharge space between the adjacent discharge cells 250 can exist.

According to the current embodiment of the present invention, the non-discharge space between the adjacent discharge cells 250 does not exist, and a discharge space therebetween basically exists. A pair of first discharge electrodes 231 is arranged inside the first barrier ribs 230, and a pair of second discharge electrodes 241 is arranged inside the second barrier ribs 240. Then, each pair of discharge electrodes performs a discharge in the adjacent discharge cells 250.

However, as shown in FIG. 2, since the widths of the second barrier ribs 240 are larger than those of the first barrier ribs 230, the second discharge electrodes 241 are arranged so that a distance d2 between the pairs of second discharge electrodes 241 is larger than a distance d1 between the pairs of first discharge electrodes 231. Then, since capacitance between the pairs of second discharge electrodes 241 can be reduced, ineffective power generated by the second discharge electrodes 241 can also be reduced. In particular, like in FIG. 2, when a voltage is supplied so that the second discharge electrodes 241 performs addressing, the ineffective power is further reduced so that the discharge efficiency can be improved.

The dielectric substance used to form the first barrier ribs 230 and the second barrier ribs 240 prevents the first discharge electrodes 231 and the second discharge electrodes 241 from being directly and electrically shorted during a sustain discharge and prevents charged particles from directly colliding with the first discharge electrodes 231 and the second discharge electrodes 241. The dielectric substance induces charged particles to accumulate wall charges. The dielectric substance can be PbO, $B_2O_3$, or $SiO_2$.

The first protective layer 232 and the second protective layer 242 are formed of magnesium oxide (MgO). The first protective layer 232 and the second protective layer 242 prevent the first and second barrier ribs 230 and 240 formed of a dielectric substance and the first and second discharge electrodes 231 and 241 from being damaged by the sputtering of plasma particles, emit secondary electrons and reduce a discharge voltage.

In addition, referring to FIG. 4, according to the current embodiment of the present invention, the discharge cells 250 partitioned by the first barrier ribs 230 and the second barrier ribs 240 have rectangular cross-sections. However, the present invention is not limited thereto. The cross-sections of the discharge cells 250 can have polygonal shapes, such as triangular or pentagonal shapes or circular shapes or elliptical shapes.

According to the current embodiment of the present invention, the first discharge electrodes 231 and the second discharge electrodes 241 cross one another. Thus, the PDP 200 can be driven using only the first discharge electrodes 231 and the second discharge electrodes 241 without additional electrodes. That is, according to the current embodiment of the present invention, the first discharge electrodes 231 serve as scan electrodes and the second discharge electrodes 241 serve as address electrodes so that addressing and a sustain discharge are effected. However, the present invention is not limited thereto and electrodes that serve as common electrodes can be additionally arranged.

According to the current embodiment of the present invention, the first discharge electrodes 231 serve as scan electrodes and the second discharge electrodes 241 serve as address electrodes. However, the present invention is not limited to this. That is, the first discharge electrodes 231 can serve as address electrodes and the second discharge electrodes 241 can serve as scan electrodes. However, as described above, in order to reduce ineffective power generated by the second discharge electrodes 241, it is advantageous that the second discharge electrodes 241 serve as address electrodes.

According to the current embodiment of the present invention, grooves 211 are formed in the first substrate 210 and a plurality of phosphor layers 260 are formed on the grooves 211. However, the present invention is not limited thereto and the phosphor layers 260 can be formed on the side surfaces of the first barrier ribs 230.

The phosphor layers 260 include components that emit visible light rays in response to ultraviolet (UV) rays. The phosphor layers 126 formed in red discharge cells include phosphors such as $Y(V,P)O_4$:Eu, the phosphor layers 126 formed in green discharge cells include phosphors such as $Zn_2SiO_4$:Mn, and the phosphor layers 126 formed in blue discharge cells include phosphors such as BAM:Eu.

A discharge gas, such as neon (Ne), xenon (Xe) or a mixed gas thereof, is sealed in the discharge cells 250.

According to the present invention including the current embodiment, a discharge surface is increased and a discharge region is enlarged so that the amount of plasma can be increased and low-voltage driving can be performed. Thus, according to the present invention, even when a high-concentration Xe gas is used as a discharge gas, low-voltage driving can be performed and luminous efficiency can be remarkably improved. As such, a problem of other PDPs, in that low-voltage driving cannot be easily performed when a high-concentration Xe gas is used as a discharge gas, is solved by the present invention.

The discharge operation of the PDP 200 of FIG. 2 is as follows. First, if a predetermined address voltage is supplied between the first discharge electrodes 231 and the second discharge electrodes 241 from an external power source, an address discharge occurs, and as a result of the address discharge, the discharge cells 250 in which a sustain discharge is to occur are selected. Then, if a sustain discharge voltage is supplied between the first discharge electrodes 231 and the second discharge electrodes 241 of the selected discharge cells 250, due to the movement of wall charges accumulated on the first discharge electrodes 231 and the second discharge electrodes 241, a sustain discharge occurs. The energy level of the excited discharge gas during the sustain discharge is reduced, and UV rays are emitted. The UV rays excite the phosphor layers 260 applied in the grooves 211 of the first substrate 210, the energy level of the excited phosphor layers 260 is reduced and visible light rays are emitted. The emitted visible light rays pass through the first substrate 210, thereby forming an image that a user can recognize.

In the PDP of FIG. 1, a sustain discharge between the scan electrodes 106 and the common electrodes 107 occurs vertically so that a discharge surface is relatively narrow. However, the sustain discharge of the PDP 200 of FIG. 2 occurs on all side surfaces on which the discharge cells 250 are defined so that a discharge surface is relatively wide.

In addition, according to the current embodiment of the present invention, the widths of the second barrier ribs 240 are larger than those of the first barrier ribs 230, and the phosphor layers 260 are formed in the grooves 211 of the first substrate 210. Due to this structure, a discharge space between the second barrier ribs 240 is reduced. Thus, a central portion C of plasma generated during a discharge is moved in an upward direction of the discharge cells 250 to be closer to the phosphor layers 260. Then, UV rays emitted from the plasma generated by the discharge are more concentratively absorbed in the phosphor layers 260 so that the visible light ray-converting efficiency is improved.

In addition, the sustain discharge according to the current embodiment of the present invention occurs in a looped curve along the side surfaces of the discharge cells 250 and is gradually diffused onto the central upper portion of the discharge cells 250. The volume of a region in which the sustain discharge occurs is increased, space charges in the discharge cells 250 are conducive to emission, and luminous efficiency is improved.

In addition, in the barrier rib structure according to the current embodiment of the present invention, the first barrier ribs 230 and the second barrier ribs 240 are separated from one another, and the first discharge electrodes 231 and the second discharge electrodes 241 are arranged inside the first barrier ribs 230 and the second barrier ribs 240. Thus, a material used to form the first discharge electrodes 231 or the second discharge electrodes 241 is removed during a baking process and prevents the first and second electrodes 231 and 241 from electrically contacting. As such, the first and second electrodes 231 and 241 can be prevented from being electrically shorted when the PDP 200 is driven.

In addition, since the widths of the second barrier ribs 240 are larger than those of the first barrier ribs 230, the distance d2 between the pairs of second discharge electrodes 241 is larger than the distance d1 between the pairs of first discharge electrodes 231. Since the capacitance between the pairs of second discharge electrodes 241 can be reduced, ineffective power generated by the second discharge electrodes 241 can also be reduced so that the discharge efficiency is improved.

A modified example of the PDP 200 of FIG. 2 is described below with reference to FIG. 5 by referring to differences between FIGS. 2 and 5.

Figure 5:
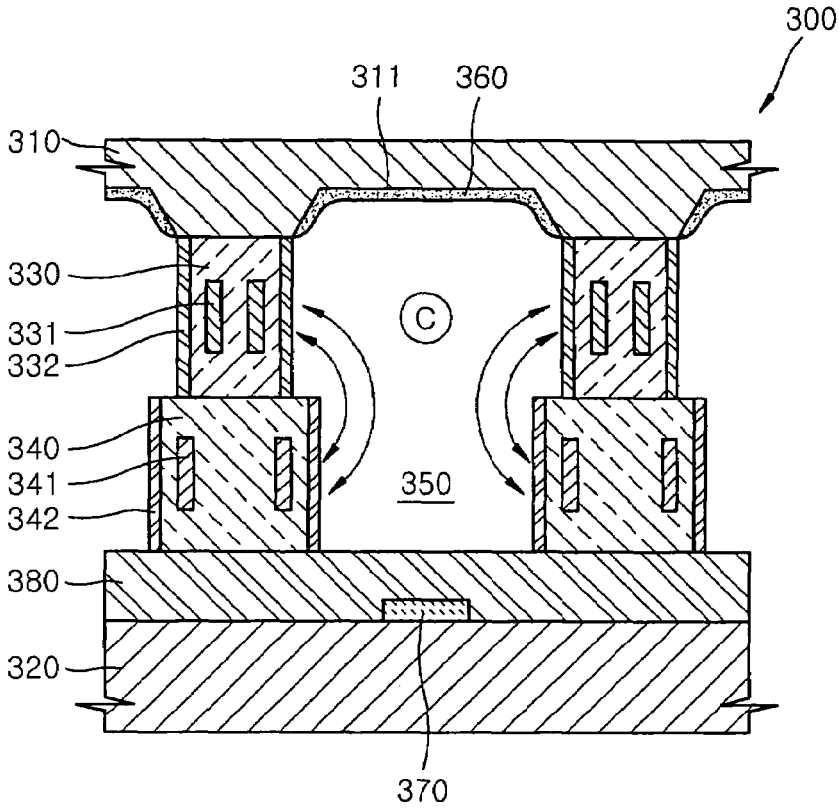
FIG. 5 is a schematic cross-sectional view of a modified example of the PDP of FIG. 2.

FIG. 5 is a schematic cross-sectional view of a modified example of the PDP 200 of FIG. 2. Referring to FIG. 5, a PDP 300 includes a first substrate 310 having grooves 311, a second substrate 320, first barrier ribs 330, a plurality of first discharge electrodes 331, a first protective layer 332, second barrier ribs 340, a plurality of second discharge electrodes 341, a second protective layer 342, and a plurality of phosphor layers 360.

There is a difference between FIGS. 2 and 5 in that the PDP 300 of FIG. 5 includes a plurality of address electrodes 70 and a dielectric layer 380.

That is, the first discharge electrodes 331 and the second discharge electrodes 341 of FIG. 5 extend in one direction to be parallel to one another, and the address electrodes 370 cross the first discharge electrodes 331 and the second discharge electrodes 341.

In this case, one of the first discharge electrodes 331 and the second discharge electrodes 341 serves as scan electrodes and the other one serves as common electrodes.

The address electrodes 370 are arranged on the second substrate 320 and the dielectric layer 380 is arranged on the address electrode 370.

As described above, an exemplary discharge operation of the PDP 300 of FIG. 5 is as follows. First, if a predetermined address voltage is supplied between one of the first discharge electrodes 331 and the second discharge electrodes 341 that serve as scan electrodes and the address electrodes 370 from an external power source, an address discharge occurs, and as a result of the address discharge, discharge cells 350 in which a sustain discharge are to occur are selected. Then, if a sustain discharge voltage is supplied between the first discharge electrodes 331 and the second discharge electrodes 341 of the selected discharge cells 350, due to the movement of wall charges accumulated on the first discharge electrodes 331 and the second discharge electrodes 341, a sustain discharge occurs. The energy level of the excited discharge gas during the sustain discharge is reduced, and UV rays are emitted. The emitted UV rays excite the phosphor layers 360 applied in the grooves 311 of the first substrate 310. The energy level of the excited phosphor layers 360 is reduced, and visible light rays are emitted. The emitted visible light rays pass through the first substrate 310, thereby forming an image that a user can recognize.

Thus, in the PDP 300 of FIG. 5, a discharge space between the second barrier ribs 340 is reduced so that a central portion C of plasma generated during a discharge is moved in an upward direction of the discharge cells 350 to be closer to the phosphor layers 360. Then, UV rays emitted from the plasma generated by the discharge are more concentratively absorbed in the phosphor layers 360 so that the visible light ray-converting efficiency is improved.

The structure, operation, and effect of the PDP 300 of FIG. 5 excluding the above-described structure, operation and effect are the same as those of the PDP 200 of FIG. 2 and thus, a description thereof has been omitted for the sake of brevity.

Another modified example of the PDP 200 of FIG. 2 is described below with reference to FIG. 6 by referring to differences between FIGS. 2 and 6.

Figure 6:
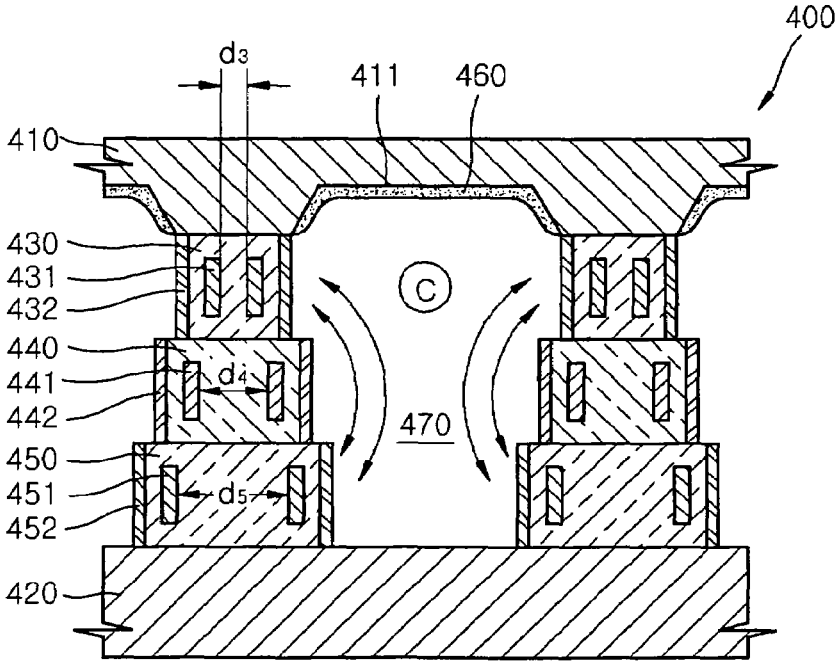
FIG. 6 is a schematic cross-sectional view of another modified example of the PDP of FIG. 2.

FIG. 6 is a schematic cross-sectional view of another modified example of the PDP 200 of FIG. 2. Referring to FIG. 6, a PDP 400 includes a first substrate 410 having grooves 411, a second substrate 420, first barrier ribs 430, a plurality of first discharge electrodes 431, a first protective layer 432, second barrier ribs 440, a plurality of second discharge electrodes 441, a second protective layer 442, third barrier ribs 450, a plurality of third discharge electrodes 451, a third protective layer 452, and a plurality of phosphor layers 460.

The differences between FIGS. 2 and 6 are that the PDP 400 of FIG. 6 include the third barrier ribs 450, the third discharge electrodes 451, and the third protective layer 452.

That is, the phosphor layers 460 are formed in the grooves 411 of the first substrate 410. In addition, since widths of the second barrier ribs 440 are larger than those of the first barrier ribs 430 and widths of the third barrier ribs 450 are larger than those of the second barrier ribs 440, the farther from the phosphor layers 460, the narrower a discharge space. Due to this structure, a central portion C of a plasma generated during a discharge is closer to the phosphor layers 460 so that visible light ray-converting efficiency during the discharge is improved.

The first discharge electrodes 431 serve as common electrodes, the second discharge electrodes 441 serve as scan electrodes, and the third discharge electrodes 451 serve as address electrodes.

Thus, the first discharge electrodes 431 and the second discharge electrodes 441 are arranged to be parallel to one another in the same direction, and the third discharge electrodes 451 are arranged to cross the first discharge electrodes 431 and the second discharge electrodes 441. However, the present invention is not limited thereto. That is, two of the first discharge electrodes 431, the second discharge electrodes 441, and the third discharge electrodes 451 are formed in the same direction, and the other one thereof can be formed to cross the discharge electrodes formed in the same direction. In this case, one of the discharge electrodes formed in the same direction serves as scan electrodes, the other discharge electrodes formed in the same direction serve as common electrodes, and the other one arranged to cross the discharge electrodes in the same direction serves as address electrodes.

In addition, since widths of the second barrier ribs 440 are larger than those of the first barrier ribs 430 and widths of the third barrier ribs 450 are larger than those of the second barrier ribs 440, a distance d4 between the pairs of second discharge electrodes 441 is greater than a distance d3 between the pairs of first discharge electrodes 431, and a distance d5 between the pairs of third discharge electrodes 451 is greater than the distance d4 between the pairs of second discharge electrodes 441. Then, since capacitance between the pairs of second discharge electrodes 441 and the pairs of third discharge electrodes 451 can be reduced, ineffective power generated by the second discharge electrodes 441 and the third discharge electrodes 451 can also be reduced so that the discharge efficiency is improved.

An exemplary discharge operation of the PDP 400 of FIG. 6 is as follows.

First, if a predetermined address voltage is supplied between the second discharge electrodes 441 and the third discharge electrodes 451, an address discharge occurs, and as a result of the address discharge, discharge cells 470 in which a sustain discharge are to occur are selected. Then, if a sustain discharge voltage is supplied between the first discharge electrodes 431 and the second discharge electrodes 441 of the selected discharge cells 470, due to the movement of wall charges accumulated on the first discharge electrodes 431 and the second discharge electrodes 441, a sustain discharge occurs. The energy level of the excited discharge gas during the sustain discharge is reduced, and UV rays are emitted. The emitted UV rays excite the phosphor layers 460 applied in the grooves 411 of the first substrate 410. The energy level of the excited phosphor layers 460 is reduced, and visible light rays are emitted. The emitted visible light rays pass through the first substrate 410, thereby forming an image that a user can recognize.

Thus, in the PDP 400 of FIG. 6, a discharge space between the second barrier ribs 440 and the third barrier ribs 450 is reduced so that a central portion C of a plasma generated during a discharge is moved in an upward direction of the discharge cells 470 to be closer to the phosphor layers 460. Then, UV rays emitted from plasma generated by a discharge are more concentratively absorbed in the phosphor layers 460 so that the visible light ray-converting efficiency is improved.

The structure, operation, and effect of the PDP 400 of FIG. 6 excluding the above-described structure, operation and effect are the same as those of the PDP 200 FIG. 2 and thus, a description thereof has been omitted for the sake of brevity.

Another embodiment of the present invention is described below with reference to FIGS. 7, 8, and 9.

Figure 7:
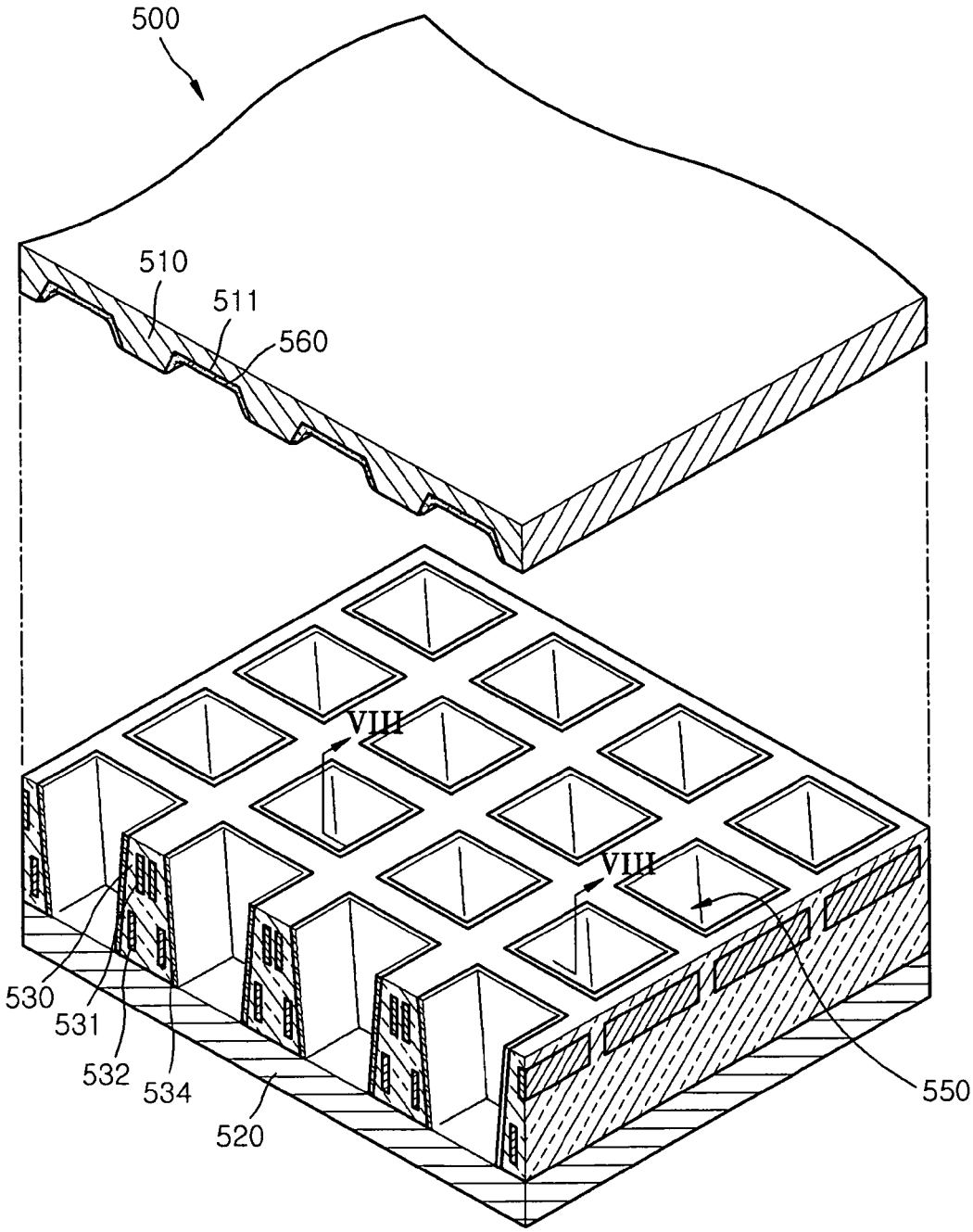
FIG. 7 is a partially cutaway perspective view of a PDP according to another embodiment of the present invention.
Figure 8:
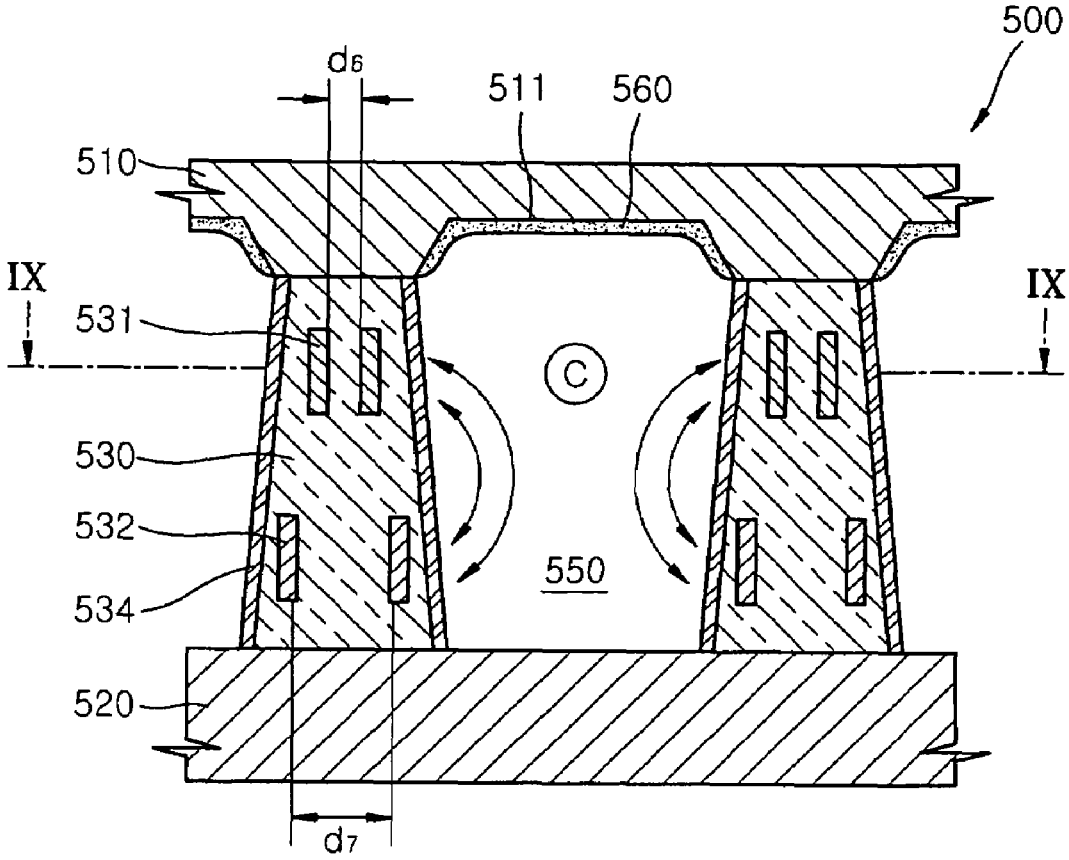
FIG. 8 is a cross-sectional view of the PDP taken along line VIII-VIII of FIG. 7.
Figure 9:
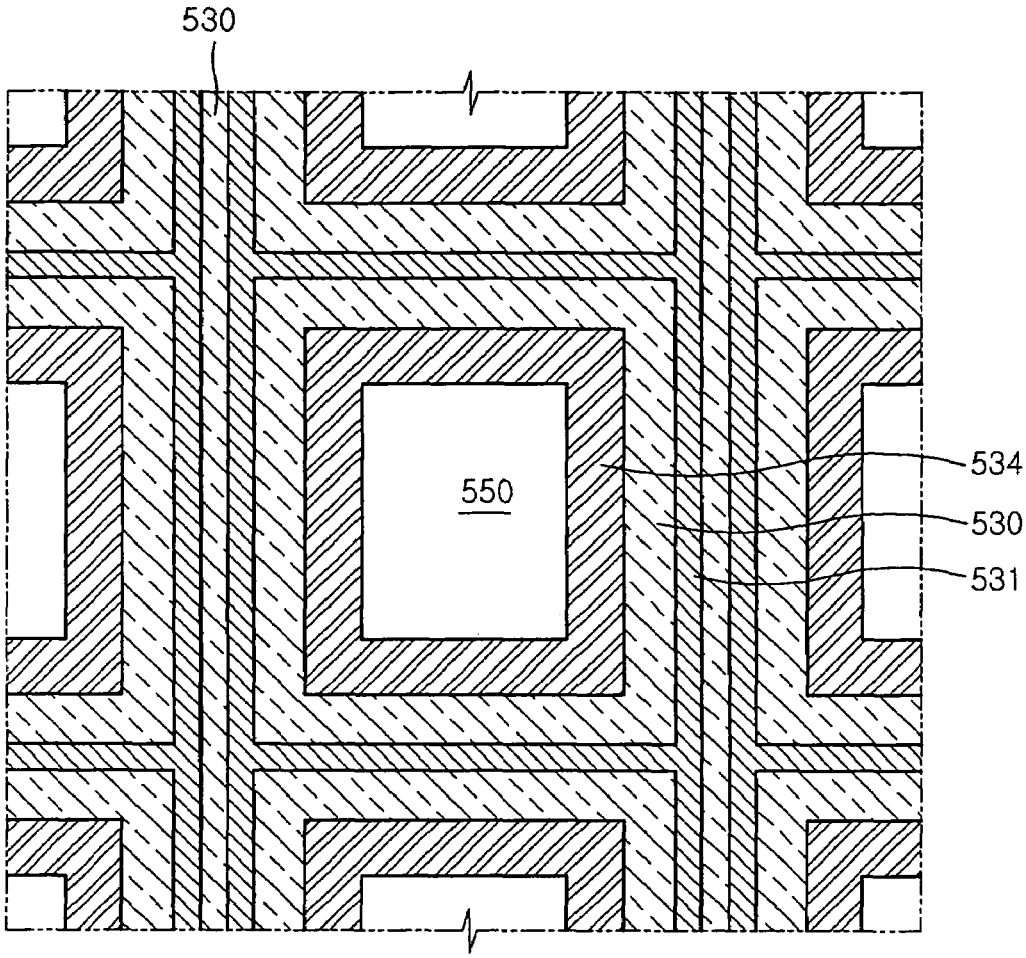
FIG. 9 is a cross-sectional view of the PDP taken along line IX-IX of FIG. 8.

FIG. 7 is a partially cutaway perspective view of a PDP according to another embodiment of the present invention, FIG. 8 is a cross-sectional view of the PDP taken along line VIII-VIII of FIG. 7, and FIG. 9 is a cross-sectional view of the PDP taken along line IX-IX of FIG. 8.

Referring to FIGS. 7, 8, and 9, a PDP 500 includes a first substrate 510 which is transparent, and a second substrate 520 separated from the first substrate 510 by a predetermined gap to be parallel thereto.

The first substrate 510 and the second substrate 520 define a plurality of discharge cells 550 partitioned by barrier ribs 530.

According to the current embodiment of the present invention, since the first substrate 510 is transparent, visible light rays generated by a discharge pass through the first substrate 510. However, the present invention is not limited thereto. That is, the second substrate 520 can be transparent or both the first and second substrates 510 and 520 can be transparent.

The barrier ribs 530 are arranged between the first substrate 510 and the second substrate 520, and cross-sections of the barrier ribs 530 have a trapezoidal shape.

According to the current embodiment of the present invention, the cross-sections of the barrier ribs 530 are limited to a trapezoid shape. The trapezoid shape includes a trapezoid shape whose cross-sectional width is continuously changed, as well as a trapezoid shape in a strict meaning. For example, even when a circular arc is included in a trapezoid, if a cross-section of a shape has a trapezoid shape, the shape can be regarded as a trapezoid shape according to the current embodiment of the present invention.

The barrier ribs 530 are formed of a dielectric substance, and a plurality of first discharge electrodes 531 and a plurality of second discharge electrodes 532 are arranged inside the dielectric substance.

A first protective layer 534 is formed on side surfaces of the barrier ribs 530.

The first discharge electrodes 531 and the second discharge electrodes 532 surround the discharge cells 550. The first discharge electrodes 531 and the discharge electrodes 532 need not to be transparent and thus can be formed of a conductive metallic material. In this way, the first discharge electrodes 531 and the second discharge electrodes 532 can be formed of a metallic material having good conductivity and low resistance, such as Ag, Al or Cu. Thus, there are many advantages that a response speed caused by a discharge is increased, signals are not distorted and power consumption required for a sustain discharge is reduced.

In addition, according to the current embodiment of the present invention, the first discharge electrodes 531 and the second discharge electrodes 532 are formed in a ladder shape but can be formed in various shapes such as ring shapes or rectangular loop shapes.

According to the current embodiment of the present invention, the first discharge electrodes 531 serve as scan electrodes and the second discharge electrodes 532 serve as address electrodes. However, the present invention is not limited thereto.

According to the current embodiment of the present invention, a non-discharge space between the adjacent discharge cells 550 does not exist. However, the present invention is not limited thereto. That is, in the PDP according to the present invention, a non-discharge space between the adjacent discharge cells 550 can exist.

According to the current embodiment of the present invention, the non-discharge space between the adjacent discharge cells 550 does not exist, and a discharge space therebetween basically exists. A pair of first discharge electrodes 531 and a pair of second discharge electrodes 532 are arranged inside the barrier ribs 530. Then, each pair of discharge electrodes performs a discharge in the adjacent discharge cells 550.

However, as shown in FIG. 8, since the widths of lower portions of the barrier ribs 530 are greater than those of upper portions of the barrier ribs 530, the second discharge electrodes 532 are arranged so that a distance d7 between the pairs of second discharge electrodes 532 is greater than a distance d6 between the pairs of first discharge electrodes 531. Then, since capacitance between the pairs of second discharge electrodes 532 can be reduced, ineffective power generated by the second discharge electrodes 532 can also be reduced. In particular, like in FIG. 7, when a voltage is supplied so that the second discharge electrodes 532 performs addressing, the ineffective power is further reduced so that the discharge efficiency can be improved.

The dielectric substance used to form the barrier ribs 530 prevents the first discharge electrodes 531 and the second discharge electrodes 532 from being directly and electrically shorted during a sustain discharge and prevents charged particles from directly colliding with the first discharge electrodes 531 and the second discharge electrodes 532. The dielectric substance induces charged particles to accumulate wall charges. The dielectric substance can be PbO, $B_2O_3$, or $SiO_2$.

The protective layer 534 is formed of magnesium oxide (MgO). The protective layer 534 prevents the barrier ribs 530 formed of a dielectric substance and the first and second discharge electrodes 531 and 532 from being damaged by sputtering of plasma particles, and emitted secondary electrons and reduce a discharge voltage.

In addition, referring to FIG. 9, according to the current embodiment of the present invention, the discharge cells 550 partitioned by the barrier ribs 530 have rectangular cross-sections. However, the present invention is not limited thereto. The cross-sections of the discharge cells 550 can have polygonal shapes, such as triangular or pentagonal shapes or circular shapes or elliptical shapes.

According to the current embodiment of the present invention, the first discharge electrodes 531 and the second discharge electrodes 532 cross one another. Thus, the PDP 500 can be driven using only the first discharge electrodes 531 and the second discharge electrodes 532 without additional electrodes. That is, according to the current embodiment of the present invention, the first discharge electrodes 531 serve as scan electrodes and the second discharge electrodes 532 serve as address electrodes so that addressing and a sustain discharge are performed. However, the present invention is not limited thereto and electrodes that serve as common electrodes can be additionally arranged.

According to the current embodiment of the present invention, the first discharge electrodes 531 serve as scan electrodes and the second discharge electrodes 532 serve as address electrodes. However, the present invention is not limited thereto. That is, the first discharge electrodes 531 can serve as address electrodes and the second discharge electrodes 532 can serve as scan electrodes. However, as described above, in order to reduce ineffective power generated by the second discharge electrodes 532, it is advantageous that the second discharge electrodes 532 serve as address electrodes.

According to the current embodiment of the present invention, grooves 511 are formed in the first substrate 510 and a plurality of phosphor layers 560 are formed on the grooves 511. However, the present invention is not limited thereto and the phosphor layers 560 can be formed on the side surfaces of the barrier ribs 530.

The phosphor layers 560 include components that emit visible light rays from ultraviolet (UV) rays. The phosphor layers 560 formed in red discharge cells include phosphors such as $Y(V,P)O_4$:Eu, the phosphor layers 560 formed in green discharge cells include phosphors such as $Zn_2SiO_4$:Mn, and the phosphor layers 560 formed in blue discharge cells include phosphors such as BAM:Eu.

A discharge gas, such as neon (Ne), xenon (Xe) or a mixed gas thereof, is sealed in the discharge cells 550.

According to the present invention including the current embodiment, a discharge surface is increased and a discharge region is enlarged so that the amount of plasma can be increased and a low-voltage driving can be used. Thus, according to the present invention, even when a high-concentration Xe gas is used as a discharge gas, low-voltage driving can be performed and luminous efficiency can be remarkably improved. As such, the present invention solves the problem of other PDPs, namely, when a high-concentration Xe gas is used as a discharge gas, a low-voltage driving cannot be used.

An exemplary discharge operation of the PDP 500 of FIG. 7 is as follows.

First, if a predetermined address voltage is supplied between the first discharge electrodes 531 and the second discharge electrodes 532 from an external power source, an address discharge occurs, and as a result of the address discharge, the discharge cells 550 in which a sustain discharge will occur are selected. Then, if a sustain discharge voltage is supplied between the first discharge electrodes 531 and the second discharge electrodes 532 of the selected discharge cells 550, due to the movement of wall charges accumulated on the first discharge electrodes 531 and the second discharge electrodes 532, a sustain discharge occurs. The energy level of the excited discharge gas during the sustain discharge is reduced, and UV rays are emitted. The emitted UV rays excite the phosphor layers 560 applied in the grooves 511 of the first substrate 510. The energy level of the excited phosphor layers 560 is reduced and visible light rays are emitted. The emitted visible light rays transmit the first substrate 510, thereby forming an image that a user can recognize.

In the PDP of FIG. 1, a sustain discharge between the scan electrodes 106 and the common electrodes 107 occurs vertically so that a discharge surface is relatively narrow. However, the sustain discharge of the PDP 500 of FIG. 7 occurs on all side surfaces on which the discharge cells 550 are defined so that a discharge surface is relatively wide.

In addition, according to the current embodiment of the present invention, the widths of the lower portions of the barrier ribs 530 are greater than those of the upper portions of the barrier ribs 530, and the phosphor layers 560 are formed in the grooves 511 of the first substrate 510. Due to this structure, a discharge space between the lower portions of the barrier ribs 530 is reduced. Thus, a central portion C of a plasma generated during a discharge is moved in an upward direction of the discharge cells 550 to be closer to the phosphor layers 560. Then, UV rays emitted from plasma generated by a discharge are more concentratively absorbed in the phosphor layers 560 so that the visible light ray-converting efficiency is improved.

In addition, the sustain discharge according to the current embodiment of the present invention occurs in a looped curve along the side surfaces of the discharge cells 550 and is gradually diffused onto the central upper portion of the discharge cells 550. The volume of a region in which the sustain discharge occurs is increased, space charges in the discharge cells 550 are conducive to emission, and luminous efficiency is improved.

In addition, since the widths of the lower portions of the barrier ribs 530 are greater than those of the upper portions of the barrier ribs 530, the distance d7 between the pairs of second discharge electrodes 532 is greater than the distance d6 between the pairs of first discharge electrodes 531. Then, since the capacitance between the pairs of second discharge electrodes 532 is reduced, ineffective power generated by the second discharge electrodes 532 is also reduced so that the discharge efficiency is improved.

In addition, since the cross-sections of the barrier ribs 530 have a trapezoid shape and are inclined at a predetermined angle, the protective layer 534 can be easily deposited and directivity can be easily formed.

A modified example of the PDP 500 of FIG. 7 is described below with reference to FIG. 10 by referring to the differences between FIGS. 7 and 10.

Figure 10:
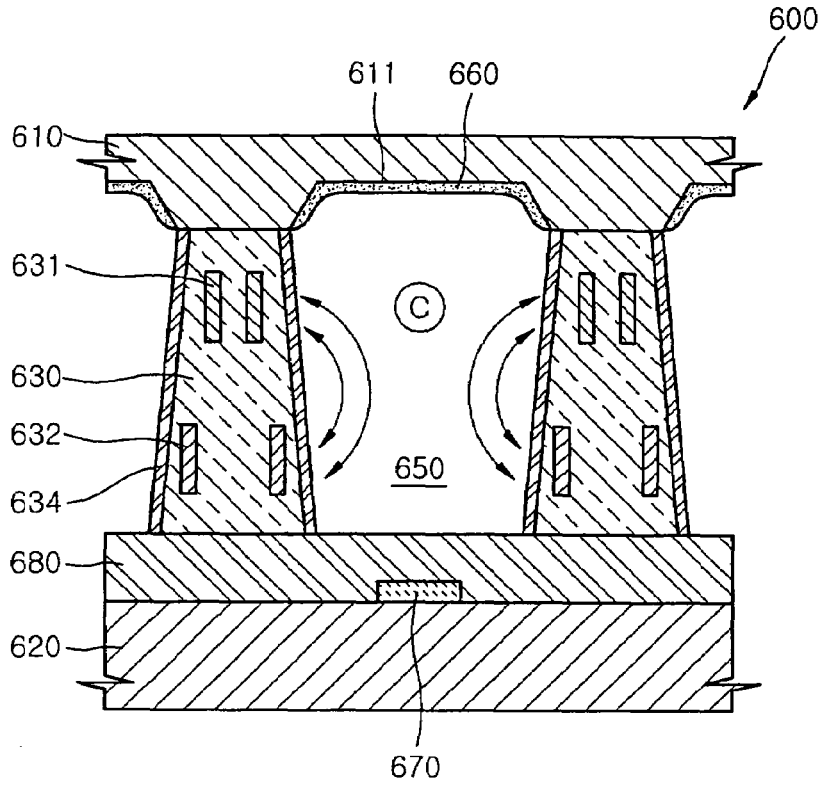
FIG. 10 is a schematic cross-sectional view of a modified example of the PDP of FIG. 7.

FIG. 10 is a schematic cross-sectional view of a modified example of the PDP 500 of FIG. 7. Referring to FIG. 10, a PDP 600 includes a first substrate 610 having grooves 611, a second substrate 620, barrier ribs 630, a plurality of first discharge electrodes 631, a plurality of second discharge electrodes 632, a protective layer 634, and a plurality of phosphor layers 660.

A difference between FIGS. 7 and 10 is that the PDP 600 of FIG. 10 includes a plurality of address electrodes 670 and a dielectric layer 680.

That is, the first discharge electrodes 631 and the second discharge electrodes 632 of FIG. 10 extend in one direction to be parallel to one another, and the address electrodes 670 cross the first discharge electrodes 631 and the second discharge electrodes 632.

In this case, one of the first discharge electrodes 631 and the second discharge electrodes 632 serves as scan electrodes and the other one serves as common electrodes.

The address electrodes 670 are arranged on the second substrate 620 and the dielectric layer 680 is arranged on the address electrode 670.

An exemplary discharge operation of the PDP 600 of FIG. 10 is as follows.

First, if a predetermined address voltage is supplied between one of the first discharge electrodes 631 and the second discharge electrodes 632 that serve as scan electrodes and the address electrodes 670 from an external power source, an address discharge occurs, and as a result of the address discharge, discharge cells 650 in which a sustain discharge are to occur are selected. Then, if a sustain discharge voltage is supplied between the first discharge electrodes 631 and the second discharge electrodes 632 of the selected discharge cells 650, due to the movement of wall charges accumulated on the first discharge electrodes 631 and the second discharge electrodes 632, a sustain discharge occurs. The energy level of the excited discharge gas during the sustain discharge is reduced, and UV rays are emitted. The emitted UV rays excite the phosphor layers 660 applied in then grooves 611 of the first substrate 610. The energy level of the excited phosphor layers 660 is reduced, and visible light rays are emitted. The emitted visible light rays transmit the first substrate 610, thereby forming an image that a user can recognize.

Thus, in the PDP 600 of FIG. 10, a discharge space between lower portions of the barrier ribs 630 is reduced so that a central portion C of plasma generated during a discharge is moved in an upward direction of the discharge cells 650 to be closer to the phosphor layers 660. Then, UV rays emitted from plasma generated by a discharge are more concentratively absorbed in the phosphor layers 660 so that the visible light ray-converting efficiency is improved.

The structure, operation, and effect of the PDP 600 of FIG. 10 excluding the above-described structure, operation and effect are the same as those of the PDP 500 of FIG. 7 and thus, a description thereof has been omitted for the sake of brevity.

Another modified example of the PDP 500 of FIG. 7 is described below with reference to FIG. 11 by referring to differences between FIGS. 7 and 11.

Figure 11:
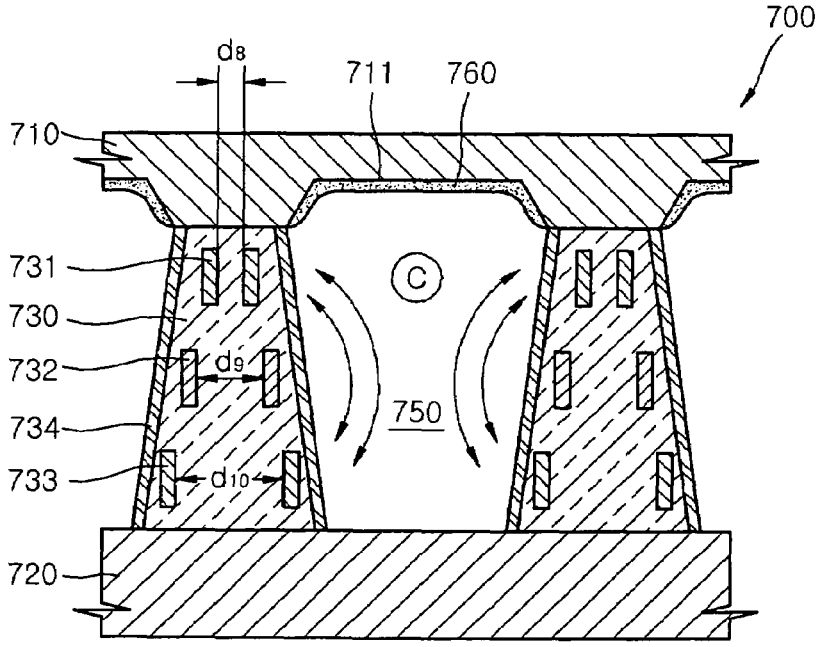
FIG. 11 is a schematic cross-sectional view of another modified example of the PDP of FIG. 7.

FIG. 11 is a schematic cross-sectional view of another modified example of the PDP 500 of FIG. 7. Referring to FIG. 11, a PDP 700 includes a first substrate 710 having grooves 711, a second substrate 720, barrier ribs 730, a plurality of first discharge electrodes 731, a plurality of second discharge electrodes 732, a plurality of third discharge electrodes 733, a protective layer 734, and a plurality of phosphor layers 760.

A difference between FIGS. 7 and 11 is that the PDP 700 of FIG. 11 further includes the third discharge electrodes 733.

That is, the phosphor layers 760 are formed in the grooves 711 of the first substrate 710. In addition, widths of lower portions of the barrier ribs 730 are greater than those of upper portions of the barrier ribs 730. That is, the farther from the phosphor layers 760, the narrower a discharge space defined by the barrier ribs 730. Due to this structure, a central portion C of a plasma generated during a discharge is closer to the phosphor layers 760 so that the visible light ray-converting efficiency caused by UV rays generated during the discharge is improved.

The first discharge electrodes 731 serve as common electrodes, the second discharge electrodes 732 serve as scan electrodes, and the third discharge electrodes 733 serve as address electrodes.

Thus, the first discharge electrodes 731 and the second discharge electrodes 732 are arranged to be parallel to one another in the same direction, and the third discharge electrodes 733 are arranged to cross the first discharge electrodes 731 and the second discharge electrodes 732. However, the present invention is not limited thereto. That is, two of the first discharge electrodes 731, the second discharge electrodes 732, and the third discharge electrodes 733 are formed in the same direction, and the other one thereof can be formed to cross the discharge electrodes formed in the same direction. In this case, one of the discharge electrodes formed in the same direction serves as scan electrodes, the other discharge electrodes formed in the same direction serve as common electrodes, and the other one arranged to cross the discharge electrodes in the same direction serves as address electrodes.

In addition, since the widths of the lower portions of the barrier ribs 730 are greater than those of the upper portions of the barrier ribs 730, a distance $d_9$ between the pairs of second discharge electrodes 732 is greater than a distance $d_8$ between the pairs of first discharge electrodes 731, and a distance $d_{10}$ between the pairs of third discharge electrodes 733 is greater than the distance $d_9$ between the pairs of second discharge electrodes 732. Then, since the capacitance between the pairs of second discharge electrodes 732 and the pairs of third discharge electrodes 733 can be reduced, ineffective power generated by the second discharge electrodes 732 and the third discharge electrodes 733 can also be reduced so that the discharge efficiency is improved.

An exemplary discharge operation of the PDP 700 of FIG. 11 is as follows.

First, if a predetermined address voltage is supplied between the second discharge electrodes 732 and the third discharge electrodes 733, an address discharge occurs, and as a result of the address discharge, discharge cells 750 in which a sustain discharge is to occur are selected. Then, if a sustain discharge voltage is supplied between the first discharge electrodes 731 and the second discharge electrodes 732 of the selected discharge cells 750, due to the movement of wall charges accumulated on the first discharge electrodes 731 and the second discharge electrodes 732, a sustain discharge occurs. The energy level of the excited discharge gas during the sustain discharge is reduced, and UV rays are emitted. The emitted UV rays excite the phosphor layers 760 applied in the grooves 711 of the first substrate 710. The energy level of the excited phosphor layers 760 is reduced, and visible light rays are emitted. The emitted visible light rays pass through the first substrate 710, thereby forming an image that a user can recognize.

Thus, in the PDP 700 of FIG. 11, a discharge space between the lower portions of the barrier ribs 730 is reduced so that a central portion C of a plasma generated during a discharge is moved in an upward direction of the discharge cells 750 to be closer to the phosphor layers 760. Then, UV rays emitted from a plasma generated by a discharge are more concentratively absorbed in the phosphor layers 760 so that the visible light ray-converting efficiency is improved.

The structure, operation, and effect of the PDP 700 of FIG. 11 excluding the above-described structure, operation and effect are the same as those of the PDP 500 of FIG. 7 and thus, a description thereof has been omitted.

The PDP according to the present invention has the following effects.

First, when visible light rays emitted in the discharge space pass through the first substrate, other elements excluding substrates do not exist in the first substrate which the visible light rays pass through such that an aperture ratio is remarkably increased and a transmission ratio is increased from less than 60% (conventional) to approximately 90%.

In addition, the barrier ribs having different widths are sequentially stacked or the cross-sections of the barrier ribs are formed in a trapezoid shape so that the central portion of a plasma generated by a discharge is closer to the phosphor layers. Then, UV rays emitted from the plasma generated by the discharge are more concentratively absorbed in the phosphor layers such that the visible light ray-converting efficiency is improved.

In addition, when the pairs of discharge electrodes are arranged inside the barrier ribs, the discharge electrodes can be arranged so that, as the widths of the barrier ribs are increased, a distance between the pairs of discharge electrodes can be increased. In this case, the capacitance between the pairs of discharge electrodes can be reduced, ineffective power generated by the discharge electrodes is reduced and the discharge efficiency is improved.

In addition, a surface discharge can occur on all side surfaces in which a discharge space is formed such that a discharge surface is enlarged approximately 4 times compared to a conventional PDP.

In addition, a discharge occurs on side surfaces in which the discharge space is formed and is diffused onto a central upper portion of the discharge space so that the plasma is concentrated on the central upper portion of the discharge space and collected in the central upper portion of the discharge space because of an electric field such that space charges can be used in the discharge, a discharge region is remarkably increased and the entire discharge space can be effectively used.

In addition, since the discharge occurs on side surfaces of the discharge space and is diffused onto the central upper portion of the discharge space, the volume of the plasma generated by the discharge is remarkably increased, the amount of the plasma is remarkably increased and UV rays corresponding to the increased amount of plasma can be emitted.

Since the PDP according to the present invention has the above-described effects, the PDP can be driven by a low voltage such that the luminous efficiency is improved.

Since the PDP according to the present invention can be driven by a low voltage, as described above, even when a high-concentration Xe gas is used as a discharge gas, the luminous efficiency can be improved.

In addition, since the discharge electrodes are not arranged on the first substrate which the visible rays pass through but are arranged on side surfaces of the discharge space, transparent electrodes having a high resistance need not be used as the discharge electrodes and metallic electrodes having low resistance can be used as the discharge electrodes, a discharge response speed is increased and low-voltage driving can be performed while waveforms are not distorted.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

a first substrate;

a second substrate arranged parallel to the first substrate;

first barrier ribs arranged between the first and second substrates and defining discharge cells with the first and second substrates;

second barrier ribs arranged between the first and second substrates and defining the discharge cells with the first substrate, the second substrate, and the first barrier ribs, the second barrier ribs being wider than the first barrier ribs;

first discharge electrodes arranged inside the first barrier ribs to surround at least part of the discharge cells;

second discharge electrodes arranged inside the second barrier ribs to surround at least part of the discharge cells, the second discharge electrodes being separated from the first discharge electrodes;

phosphor layers arranged inside the discharge cells, the phosphor layers being closer to the first barrier ribs than to the second barrier ribs; and a discharge gas contained within the discharge cells.

2. The PDP of claim 1, wherein the first discharge electrodes extend in one direction and the second discharge electrodes extend to cross the first discharge electrodes.

3. The PDP of claim 1, further comprising address electrodes crossing the first and second discharge electrodes, wherein the first and second discharge electrodes extend in one direction.

4. The PDP of claim 3, wherein one of the first and second substrates is devoid of phosphor layers, and wherein the address electrodes are arranged on the one of the first and second substrates devoid of phosphor layers, and wherein a dielectric layer is arranged on the address electrodes.

5. The PDP of claim 1, wherein one of the first and second substrates is closer to the first barrier ribs and has grooves and wherein the phosphor layers are arranged in the grooves.

6. The PDP of claim 1, wherein a pair of first discharge electrodes is arranged inside the first barrier ribs and a pair of second discharge electrodes is arranged inside the second barrier ribs, and wherein a distance between the pair of second discharge electrodes is greater than a distance between the pair of first discharge electrodes.

7. A Plasma Display Panel (PDP), comprising:

a first substrate;

a second substrate arranged parallel to the first substrate;

barrier ribs arranged between the first and second substrates and defining discharge cells with the first and second substrates and having cross-sections having a trapezoid shape;

first discharge electrodes arranged inside the barrier ribs to surround at least part of the discharge cells;

second discharge electrodes arranged inside the barrier ribs to surround at least part of the discharge cells, the second discharge electrodes being separated from the first discharge electrodes;

phosphor layers arranged closer to a portion of the barrier ribs having a minimum cross-sectional width than to a portion of the barrier ribs having a maximum cross-sectional width, the phosphor layers being arranged inside the discharge cells; and a discharge gas contained within the discharge cells.

8. The PDP of claim 7, wherein the first discharge electrodes extend in one direction and the second discharge electrodes extend to cross the first discharge electrodes.

9. The PDP of claim 7, further comprising address electrodes crossing the first and second discharge electrodes, wherein the first and second discharge electrodes extend in one direction.

10. The PDP of claim 9, wherein one of the first and second substrates is devoid of phosphor layers, and wherein the address electrodes are arranged on the one of the first and second substrates devoid of phosphor layers, and wherein a dielectric layer is arranged on the address electrodes.

11. The PDP of claim 7, wherein one of the first and second substrates is closer to the cross-sectional portion of the barrier ribs having a minimum width, and wherein the one of the first and second substrates closer to the cross-sectional portion of the barrier ribs having the minimum width has grooves and wherein the phosphor layers are arranged in the grooves.

12. The PDP of claim 7, wherein a pair of first discharge electrodes and a pair of second discharge electrodes are arranged inside the barrier ribs, and wherein a distance between the pair of second discharge electrodes is greater than a distance between the pair of first discharge electrodes.

13. A Plasma Display Panel (PDP), comprising:

a first substrate;

a second substrate arranged parallel to the first substrate;

first barrier ribs arranged between the first and second substrates and defining discharge cells with the first and second substrates;

second barrier ribs arranged between the first and second substrates, defining the discharge cells with the first substrate, the second substrate, and the first barrier ribs, the second barrier ribs being wider than the first barrier ribs;

third barrier ribs arranged between the first and second substrates, defining the discharge cells with the first substrate, the second substrate, the first barrier ribs, and the second barrier ribs, the third barrier ribs being wider than the second barrier ribs;

first discharge electrodes arranged inside the first barrier ribs to surround at least part of the discharge cells;

second discharge electrodes arranged inside the second barrier ribs to surround at least part of the discharge cells, the second discharge electrodes being separated from the first discharge electrodes;

third discharge electrodes arranged inside the third barrier ribs to surround at least part of the discharge cells, the third discharge electrodes being separated from the second discharge electrodes;

phosphor layers arranged closer to the first barrier ribs than to the second and third barrier ribs, the phosphor layers being arranged inside the discharge cells; and a discharge gas contained within the discharge cells.

14. The PDP of claim 13, wherein one of the first through third discharge electrodes extends to cross directions of the other of the first through third discharge electrodes.

15. The PDP of claim 13, wherein one of the first and second substrates is closer to the first barrier ribs, and wherein the one of the first and second substrates closer to the first barrier ribs has grooves and wherein the phosphor layers are arranged in the grooves.

16. The PDP of claim 13, wherein a pair of first discharge electrodes is arranged inside the first barrier ribs and a pair of second discharge electrodes is arranged inside the second barrier ribs, and wherein a distance between the pair of second discharge electrodes is greater than a distance between the pair of first discharge electrodes.

17. The PDP of claim 13, wherein a pair of first discharge electrodes is arranged inside the first barrier ribs, a pair of second discharge electrodes is arranged inside the second barrier ribs and a pair of third discharge electrodes is arranged inside the third barrier ribs, and wherein a distance between the pair of third discharge electrodes is greater than a distance between the pair of second discharge electrodes.

18. The PDP of claim 16, wherein a pair of first discharge electrodes is arranged inside the first barrier ribs, a pair of second discharge electrodes is arranged inside the second barrier ribs and a pair of third discharge electrodes is arranged inside the third barrier ribs, and wherein a distance between the pair of third discharge electrodes is greater than a distance between the pair of second discharge electrodes.

19. A Plasma Display Panel (PDP), comprising:

a first substrate;

a second substrate arranged parallel to the first substrate;

barrier ribs arranged between the first and second substrates, defining discharge cells with the first and second substrates and having cross-sections having a trapezoid shape;

first discharge electrodes arranged inside the barrier ribs to surround at least part of the discharge cells;

second discharge electrodes arranged inside the barrier ribs to surround at least part of the discharge cells, the second discharge electrodes being separated from the first discharge electrodes;

third discharge electrodes arranged inside the barrier ribs to surround at least part of the discharge cells, the third discharge electrodes being separated from the second discharge electrodes;

phosphor layers arranged closer to a portion of the barrier ribs having a minimum width cross-section than to a portion of the barrier ribs having a maximum width cross-section, the phosphor layers being arranged inside the discharge cells; and a discharge gas contained within the discharge cells.

20. The PDP of claim 19, wherein one of the first through third discharge electrodes extends to cross directions of the other of the first through third discharge electrodes.

21. The PDP of claim 19, wherein one of the first and second substrates is closer to the portion of the barrier ribs having the minimum width cross-section, and wherein the one of the first and second substrates closer to the portion of the barrier ribs having the minimum width cross-section has grooves and wherein the phosphor layers are arranged in the grooves.

22. The PDP of claim 19, wherein a pair of first discharge electrodes and a pair of second discharge electrodes are arranged inside the barrier ribs, and wherein a distance between the pair of second discharge electrodes is greater than a distance between the pair of first discharge electrodes.

23. The PDP of claim 19, wherein a pair of first discharge electrodes, a pair of second discharge electrodes, and a pair of third discharge electrodes are arranged inside the barrier ribs, and wherein a distance between the pair of third discharge electrodes is greater than a distance between the pair of second discharge electrodes.

24. The PDP of claim 22, wherein a pair of first discharge electrodes, a pair of second discharge electrodes, and a pair of third discharge electrodes are arranged inside the barrier ribs, and wherein a distance between the pair of third discharge electrodes is greater than a distance between the pair of second discharge electrodes.

* * * * *